US006853277B2

(12) United States Patent
Castonguay et al.

(10) Patent No.: US 6,853,277 B2
(45) Date of Patent: Feb. 8, 2005

(54) AUXILIARY MAGNETIC TRIP SYSTEM

(75) Inventors: Roger N. Castonguay, Terryville, CT (US); David Arnold, Chester, CT (US)

(73) Assignee: General Electric Company, Schenectady, NY (US)

( * ) Notice: Subject to any disclaimer, the term of this patent is extended or adjusted under 35 U.S.C. 154(b) by 136 days.

(21) Appl. No.: 10/064,678

(22) Filed: Aug. 6, 2002

(65) Prior Publication Data

US 2003/0034864 A1 Feb. 20, 2003

Related U.S. Application Data

(62) Division of application No. 09/682,313, filed on Aug. 17, 2001, now Pat. No. 6,507,256.

(51) Int. Cl.[7] ..... H01H 9/00
(52) U.S. Cl. ..... 335/172; 335/174
(58) Field of Search ..... 335/23–42, 165–176, 335/202

(56) References Cited

U.S. PATENT DOCUMENTS

| | | | |
|---|---|---|---|
| 4,764,650 | A | 8/1988 | Bur et al. |
| 4,951,015 | A | 8/1990 | Shea et al. |
| 5,731,560 | A | 3/1998 | Nebon et al. |
| 6,018,284 | A | 1/2000 | Rival et al. |
| 6,054,912 | A | 4/2000 | Kaneko et al. |

*Primary Examiner*—Lincoln Donovan
(74) *Attorney, Agent, or Firm*—Cantor Colburn LLP

(57) ABSTRACT

An auxiliary magnetic trip system for a circuit breaker, the auxiliary magnetic trip system includes a strap configured to conduct a first level of electrical current and a second level of electrical current; a u-shape collar with a first pole face, the u-shape collar disposed around the strap; a trip lever rotatably mounted on an axis; and a holdback system releasably coupled to the trip lever, wherein the holdback system prevents movement of the trip lever at the first level of electrical current and releases the trip lever at the second level of electrical current.

21 Claims, 10 Drawing Sheets

AUXILIARY MAGNETIC TRIP SYSTEM

CROSS REFERENCE TO RELATED APPLICATIONS

This application is a divisional application of U.S. application Ser. No. 09/682,313 filed Aug. 17, 2001 now U.S. Pat. No. 6,507,256, which is hereby incorporated by reference in its entirety.

BACKGROUND OF THE INVENTION

Circuit breakers are used to protect equipment from overcurrent situations caused, for example, by short circuits or ground faults in or near such equipment. In the event an overcurrent condition occurs, electrical contacts within the circuit breaker will open, stopping the flow of electrical current through the circuit breaker to the equipment. Circuit breakers may be designed for high quiescent currents and high withstand currents. To maintain a high withstand current rating, the contacts must be clamped closed at the current withstand rating. On the other hand, at the short circuit current level, the contacts must be capable of opening quickly. The drawback of having the contacts clamped close is that the contacts may not be able to open quickly at the short circuit current level.

BRIEF DESCRIPTION OF THE INVENTION

The above discussed and other drawbacks and deficiencies of the prior art are overcome or alleviated by an auxiliary magnetic trip system and a method of tripping a circuit breaker. In an exemplary embodiment of the invention, the auxiliary magnetic trip system includes a strap configured to conduct a first level of electrical current and a second level of electrical current; a first u-shape collar with a first pole face, the first u-shape collar disposed around the strap; a trip lever rotatably mounted on an axis; and a holdback system releasably coupled to the trip lever, wherein the holdback system prevents movement of the trip lever at the first level of electrical current and releases the trip lever at the second level of electrical current. A method of tripping a circuit breaker includes flowing a first level of electrical current through a strap; inducing a magnetic force proportional to said first level of electrical current between a first pole face and a trip lever; preventing movement of said trip lever at said first level of electrical current; and releasing said trip lever at a second level of electrical current. The auxiliary magnetic trip system may be employed in a circuit breaker, such as for example a molded case circuit breaker, a rotary two-contact circuit breaker, an air circuit breaker, a residential circuit breaker, an industrial circuit breaker, a commercial circuit breaker, a miniature circuit breaker, a power circuit breaker, an insulated case circuit breaker, or any other circuit breaking device that has a withstand current rating and a short circuit current rating.

BRIEF DESCRIPTION OF THE DRAWINGS

Referring to the exemplary drawings wherein like elements are numbered alike in the several Figures.

DETAILED DESCRIPTION

Figure 1:
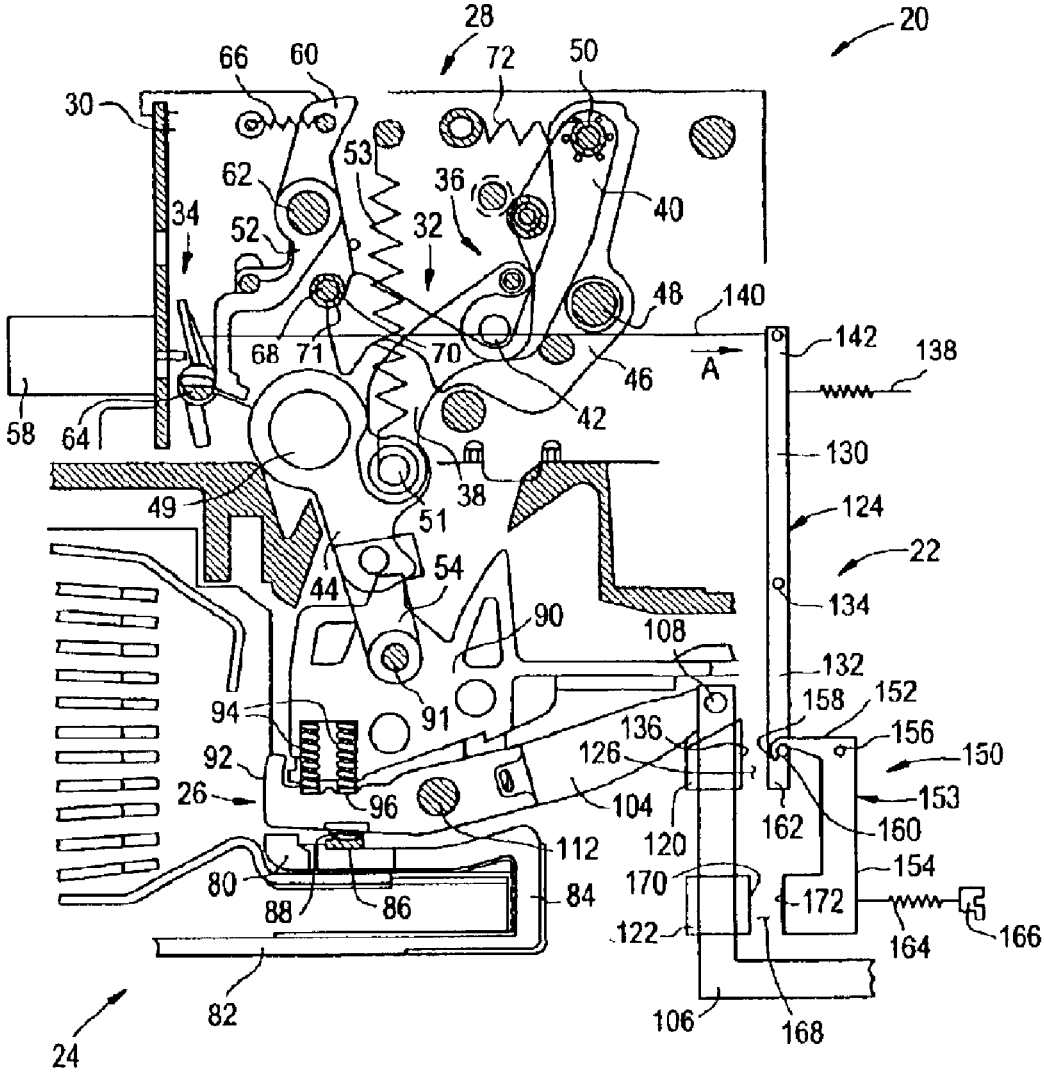
FIG. 1 is a schematic view of a pole of a circuit breaker comprising an auxiliary magnetic trip mechanism.

Referring to FIG. 1, a multi-pole circuit breaker 20 comprises an auxiliary magnetic trip system 22 that provides a means for sensing a predetermined high withstand current in circuit breaker 20 and maintaining contact between a first contact structure 24 and a second contact structure 26 during the predetermined high withstand current. Auxiliary magnetic trip system 22 also provides a means for sensing a predetermined short circuit current and quickly tripping an operating mechanism 28 to separate first contact structure 24 and second contact structure 26 in response to the short circuit current.

Operating mechanism 28 is supported by a frame 30 and comprises an operating linkage system 32 and a trip latch system 34. Operating linkage system 32 includes a toggle device 36 having a lower rod 38 and an upper rod 40 articulated on a pivoting axis 42. Operating linkage system 32 also includes a tripping hook 46, which is mounted with limited rocking movement on a main axis 48 between a loaded position, as shown in FIG. 1, and a tripped position, as will be described in further detail hereinafter. Main axis 48 is secured to frame 30. Lower rod 38 of operating linkage system 32 is pivotably coupled to second contact structure 26 through a crank 44 and a connecting rod 54. Crank 44 is pivotably secured to frame 30 by a pin 49 and is pivotably secured to lower rod 38 by a pin. An operating spring 53 extends from frame 30 to pin 51 and biases crank 44 in the counter-clockwise direction around pin 49.

Trip latch system 34 includes an opening latch 52 releasably restrained by a trip latch 64. Opening latch 52 includes a locking lever 60 pivotally mounted on a spindle 62 between a locked position and an unlocked position. Trip latch system 34 also includes a return spring 66, which biases opening latch 52 counter-clockwise around spindle 62 to the locked position. A roller 68 is arranged on locking lever 60 between spindle 62 and trip latch 64 and operates to releasably engage a bearing surface 70 of tripping hook 46. Bearing surface 70 of tripping hook 46 has a recess 71 in which roller 68 engages. A return spring 72 is secured to frame 30 to bias tripping hook 46 counter-clockwise around main axis 48 to the loaded position, in which roller 68 of opening latch 52 is engaged in recess 71 of bearing surface 70.

Second contact structure 26 includes an insulating carrier 90 pivotally coupled to a movable contact arm 92 by axis 112. Contact pressure springs 94 are arranged between carrier 90 and an upper face 96 of movable contact arm 92. A load contact 88 is coupled to movable contact arm 92. Carrier 90 is coupled to connecting rod 54 by a pin 91. Movable contact arm 92 is pivotably connected to a conductor 104 by an axis 112. Conductor 104 is pivotably connected to a connection strap 106 by an axis 108. Carrier 90 is also pivotally connected to connection strap 106 by axis 108.

Second contact structure 26 contacts first contact structure 24 at load contact 88. First contact structure 24 includes a line contact 86 coupled to a stationary contact arm 80. Stationary contact arm 80 is coupled to a contact strap 82 by a bridge conductor 84. First contact structure 24 is stationary and does not move.

In the loaded position shown, operating spring 53 biases crank 44 in a counter-clockwise direction around pin 49. Operating spring 53 also biases tripping hook 46 via lower rod 38 and upper rod 40, in a clockwise direction around main axis 48, which forces bearing surface 70 against roller 68. The force of bearing surface 70 against roller 68 biases opening latch 52 in a clockwise direction around spindle 62 and forces opening latch 52 against trip latch 64. Trip latch 64 prevents rotation of opening latch 52 around spindle 62, which, in turn, prevents rotation of tripping hook 46 around main axis 48 and rotation of crank 44 around pin 49.

Trip latch 64 may be rotated by a tripping component 58 to release locking lever 60, resulting in tripping of operating mechanism 28, which moves second contact structure 26 away from first contact structure 24. Tripping component 58 may be actuated manually, notably by means of a pushbutton, or automatically by the auxiliary magnetic trip system.

Referring to FIG. 1, a first embodiment of auxiliary magnetic trip system 22 is illustrated. Auxiliary magnetic trip system 22 includes a holdback system 150, which is coupled with operating linkage system 32 through trip latch system 34.

Auxiliary magnetic trip system 22 includes a first u-shaped collar 120 disposed around connection strap 106 and a second u-shaped collar 122 disposed around to connection strap 106. First u-shaped collar 120 and second u-shaped collar 122 may be a yoke, a c-shaped collar, or the like. Auxiliary magnetic trip system 22 also includes a trip lever 124, which is located proximate to connection strap 106. Trip lever 124 comprises a first trip arm 130 rotatably coupled to a second trip arm 132 by an axis 134. First u-shaped collar 120 has a pole face 136 that attracts second trip arm 132 when current flows through connection strap 106. In addition, there is a gap 126 between pole face 136 and second trip arm 132. Gap 126 is sized so that first u-shaped collar 120 produces a desired amount of force on second trip arm 132.

First trip arm 130 is biased in a counter-clockwise direction around axis 134 by a spring 138. Spring 138 is coupled between first trip arm 130 and frame 30. An end 142 of first trip arm 130 is coupled to trip latch 64 by a linkage connection 140. Linkage connection 140 may be a wire link or any means to connect first trip arm 130 to trip latch 64.

Trip lever 124 is coupled to holdback system 150. Holdback system 150 includes an armature 153, which has a latch arm 152 coupled to an arm 154 by an axis 156. Latch arm 152 includes a latching end 158, which hooks on a latch pin 160. Latch pin 160 is connected to an end 162 of second trip arm 132. Arm 154 is located proximate second u-shaped collar 122 with a gap 168 disposed between a pole face 170 of second u-shaped collar 122 and a face 172 of arm 154. A retainer spring 164 is coupled between arm 154 and frame 30. A calibration screw 166 is coupled with retainer spring 164 and is threadably engaged to bias armature 153 in a counter-clockwise direction about axis 156. Calibration screw 166 provides a predetermined amount of tension on retainer spring 164.

Auxiliary magnetic trip system 22 operates in the following manner. When first contact structure 24 is in contact with second contact structure 26 (i.e., in the "closed", "locked", or "clamped" position), current flows from contact strap 82 through bridge conductor 84 to stationary contact arm 80 to line contact 86 to load contact 88. Current then flows through movable contact arm 92 to conductor 104. Because the current from stationary contact arm 80 to movable contact arm 92 is a reverse loop, there is an opposing electromagnetic force between movable contact arm 92 and stationary contact arm 80. However, line contact 86 and load contact 88 stay in the closed position because operating mechanism 28 holds movable contact arm 92 so that movable contact arm 92 does not pivot open. The amount of current that can flow through circuit breaker 20 without tripping circuit breaker 20 is called the withstand level. Because first contact structure 24 and second contact structure 26 stay in the closed position, the circuit breaker is "withstanding" the flow of current.

The current flows from conductor 104 to connection strap 106. As current flows through connection strap 106, a magnetic flux is induced in first u-shaped collar 120 and second u-shaped collar 122, thereby creating a magnetic force between pole face 136 and second trip arm 132. As current increases though connection strap 106, the magnetic force at pole face 136 and second trip arm 132 increases and second trip arm 132 attempts to move towards pole face 136. However, latching end 158, which is hooked on latch pin 160 prevents second trip arm 132 from moving and, in essence, holds back trip lever 124.

In addition, as current flows through connection strap 106, a magnetic flux is induced in second u-shaped collar 122, thereby creating a magnetic force between pole face 170 and face 172 of arm 154. Retainer spring 164 holds arm 154 in place and does not allow arm 154 to move towards pole face 170 until the magnetic force between arm 154 and pole face 170 exceeds a predetermined threshold. Calibration screw 166 can be adjusted to adjust the predetermined threshold.

As current further increases, the magnetic force on second u-shaped collar 122 increases and eventually overcomes retainer spring 164. This level of current is called the short circuit current level, which is the level of current at which first contact structure 24 and second contact structure 26 separate. Second contact structure 26 moves away from first contact structure 24 because at the point the magnetic force overcomes retainer spring 164, arm 154 is pulled toward pole face 170. When arm 154 moves towards pole face 170, armature 153 rotates about axis 156. As armature 153 rotates about axis 156, latching end 158 releases its hook on latch pin 160 and second trip arm 132 is then free to rotate toward pole face 136. As second trip arm moves toward pole face 136, trip lever 124 rotates about axis 134 in a clockwise direction. As trip lever 124 moves in a clockwise direction, end 142 pulls on linkage connection 140, which pulls trip latch 64 and trips operating mechanism 28.

Operating mechanism 28 trips when trip latch 64 rotates in a clockwise direction, which allows opening latch 52 to pivot about spindle 62 in a clockwise direction under the force of tripping hook 46 until bearing surface 70 is released from roller 68. Once bearing surface 70 is released from roller 68, tripping hook 46 is free to rotate about main axis 48. In addition, crank 44 is free to rotate about pin 49 under the urgence of operating spring 53, which causes second contact structure 26 to move away from first contact structure 24 so that line contact 86 and load contact 88 are no longer touching. When line contact 86 and load contact 88 separate, the circuit breaker is "tripped" and current can no longer flow through the circuit breaker.

The tripping action occurs very quickly for two reasons. First, once armature 153 releases from latch pin 160, the magnetic force already existing at pole face 136 and, second trip arm 132 is already existing, allowing the magnetic force to immediately attract second trip arm 132 to pole face 136. Second, the existing opposing force at line contact 86 and load contact 88 also assist in pushing second contact structure 26 away from first contact structure 24. By varying gap 126, gap 168, and the size of pole face 136 and pole face 170, the amount of magnetic force can be controlled so that the amount of pull on second trip arm 132 and arm 154 occurs at a predetermined current level.

Figure 2:
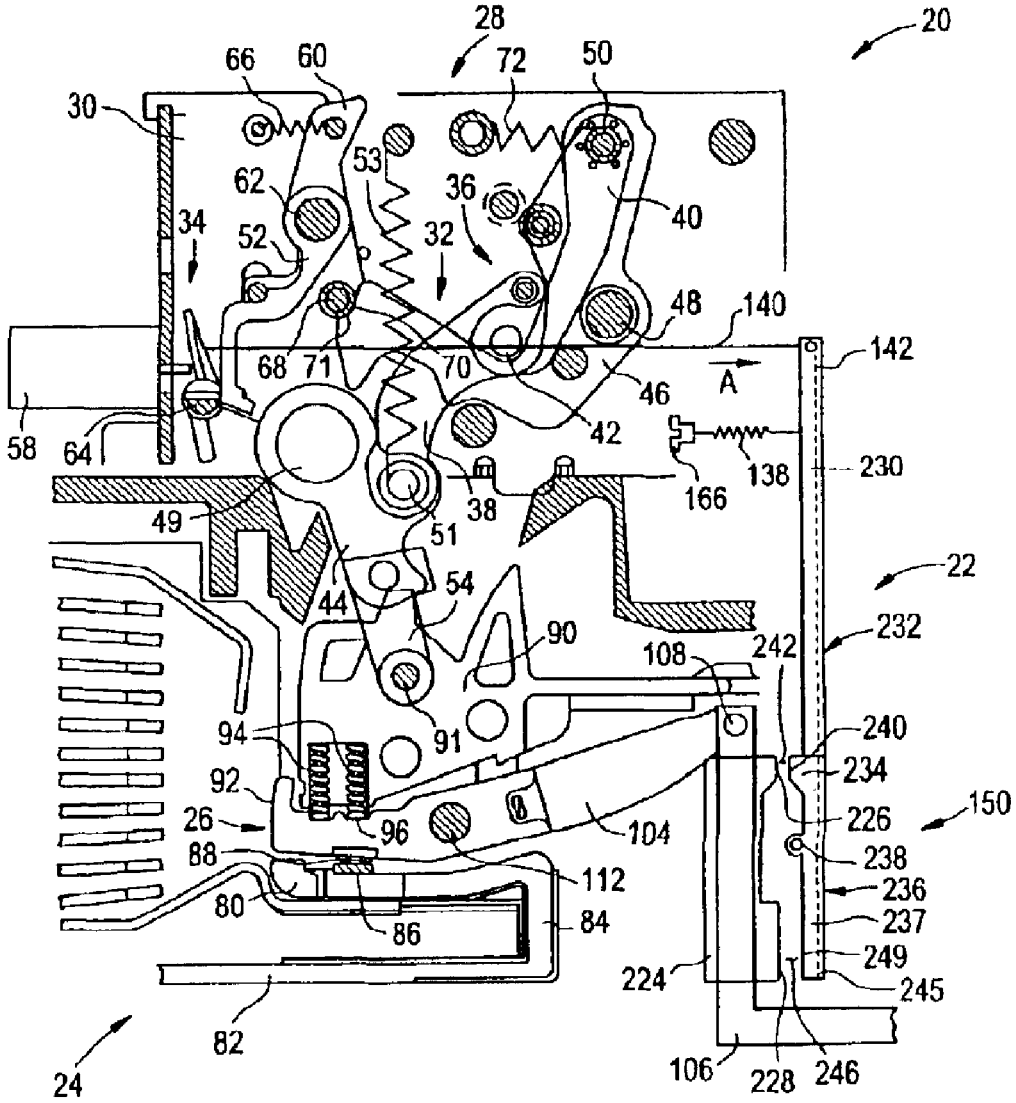
FIG. 2 is a schematic view of a second alternative embodiment of a pole of a circuit breaker comprising an auxiliary magnetic trip mechanism.

Referring to FIG. 2, a second alternative embodiment of auxiliary magnetic trip system 22 is illustrated. This embodiment utilizes the same operating mechanism 28, first contact structure 24, and second contact structure 26 as was described in the embodiment described in FIG. 1 (the first embodiment); however, auxiliary magnetic trip system 22 is different from the first embodiment. As with the first embodiment, conductor 104 is pivotably connected to connection strap 106 by axis 108. Auxiliary magnetic trip system 22 also includes holdback system 150 as with the embodiment described in FIG. 1; however, holdback system 150 in FIG. 2 operates in a different manner as holdback system 150 shown in FIG. 1. Auxiliary magnetic trip system 22 includes a u-shaped collar 224 with a first pole face 226 and a second pole face 228. First pole face 226 is smaller than second pole face 228. As with the first embodiment, u-shaped collar 224 may be a yoke, a c-shaped collar, or the like.

Auxiliary magnetic trip system 22 also includes a trip lever 232 located proximate to connection strap 106. A spring 138 is coupled between trip lever 232 and frame 30. Spring 138 is an extension spring so that it biases trip lever 232 in a counter-clockwise direction. A calibration screw 166 is coupled with spring 138 and is threadably engaged to bias trip lever 232 in a counter-clockwise direction. Calibration screw 166 provides a predetermined amount of tension on spring 138. End 142 of trip lever 232 is coupled to trip latch 64 by a linkage connection 140. Linkage connection 140 may be a wire link or any means to connect trip lever 232 to trip latch 64.

Trip lever 232 includes an arm 230 coupled to an armature 236. Armature 236 includes a first arm 234 coupled to second arm 237 by an axis 238. First pole face 226 faces a side 240 of first arm 234. Between first pole face 226 and side 240, there may be a small gap 242 or first pole face 226 may touch side 240. In the event that gap 242 exists, then first pole face 226 may be coated with a non-magnetic plating material (not shown), such as copper, or a thin sheet of copper may be attached to first pole face 226. Alternatively, first pole face 226 may contact side 240. If first pole face 226 contacts side 240, then first pole face 226 is not coated with any material.

Holdback system 150 of this embodiment includes first pole face 226, which has a polarity that attracts side 240 and pulls side 240 to first pole face 226 so that trip lever 232 rotates about axis 238 in a counter-clockwise direction. Trip lever 232 only moves the distance of gap 242 before side 240 abuts first pole face 226 and stops the rotation of trip lever 232. In the event that there is no gap, trip lever 232 cannot move at all when first pole face 226 has a magnetic force that attracts first arm 234.

Second pole face 228 faces a side 249 of second arm 237. Side 249 is located at an end 245 of second arm 237. There is a gap 246 between second pole face 228 and second arm 237. Second pole face 228 has a polarity so that it attracts second arm 237 towards second pole face 228, which wants to rotate trip lever 232 in a clockwise direction. First pole face 226 works with first arm 234 to rotate trip lever 232 in a counter-clockwise direction and second pole face 228 works with second arm 237 to rotate trip lever 232 in a clockwise direction. Thus, there is a balance condition until the magnetic force at second pole face 228 overcomes the magnetic force at first pole face 226. In addition, the magnetic force between second pole face 228 and side 249 must overcome the tension in spring 138 before trip lever 232 rotates in a clockwise direction.

Auxiliary magnetic trip system 22 operates in the following manner. Current flows through first contact structure 24 to second contact structure 26 in the manner described in the first embodiment. As current travels through connection strap 106, a magnetic flux is induced in u-shaped collar 224, thereby creating a magnetic force between first pole face 226 and trip lever 232. As the current increases through connection strap 106, the magnetic force increases in first pole face 226 and causes trip lever 232 to be pulled in a counterclockwise direction. This magnetic force along with retainer spring 138 holds back trip lever 232 and prevents trip lever 232 from rotating in a clockwise direction. As the current through connection strap 106 increases, the magnetic force continues to increase until the material at first pole face 226 saturates and the magnetic force cannot increase any further at first pole face 226.

In addition, as current flows through connection strap 106, a magnetic flux is also induced at second pole face 228 and a second magnetic force is created. At the lower current levels, the magnetic force at second pole face 228 is less than first pole face 226 because gap 246 is larger than gap 242. However, first pole face 226 will also saturate before second pole face 228 because first pole face 226 is smaller than second pole face 228. Thus, once first pole face 226 saturates and the current continues to increase, the magnetic force at second pole face 228 continues to increase before it saturates because it has a larger face area.

At or about the current level where the first pole face 226 saturates, the level of current flowing through connection strap 106 is called the withstand level. As the magnetic force increases above the withstand level, there is point when second pole face 228 has a large enough magnetic force to overcome the magnetic force at first pole face 226 and the bias of retainer spring 138. At that point, second pole face 228 attracts second arm 237 towards second pole face 228. When second arm 237 begins to move toward second pole face 228, trip lever 232 rotates about axis 238 in a clockwise direction, which pulls linkage connection 140 and ultimately, trips latch 64.

Side 240 and side 249 are located on opposing sides of axis 238. Such an arrangement allows the magnetic force at first pole face 226 to rotate trip lever 232 in a counter-clockwise direction, which prevents trip latch system 34 from tripping and also allows the magnetic force at second pole face 228 to rotate trip lever 232 in a clockwise direction, which allows trip latch system 34 to trip.

When trip latch 64 rotates, it releases operating mechanism 28 and causes operating mechanism 28 to trip. Operating mechanism 28 trips in the same manner as described above in the first embodiment. When operating mechanism trips, second contact structure 26 moves away from first contact structure 24 so that line contact 86 and load contact 88 are no longer touching. When line contact 86 and load contact 88 separate, the circuit breaker is "tripped" and current can no longer flow through circuit breaker 20.

Figure 3:
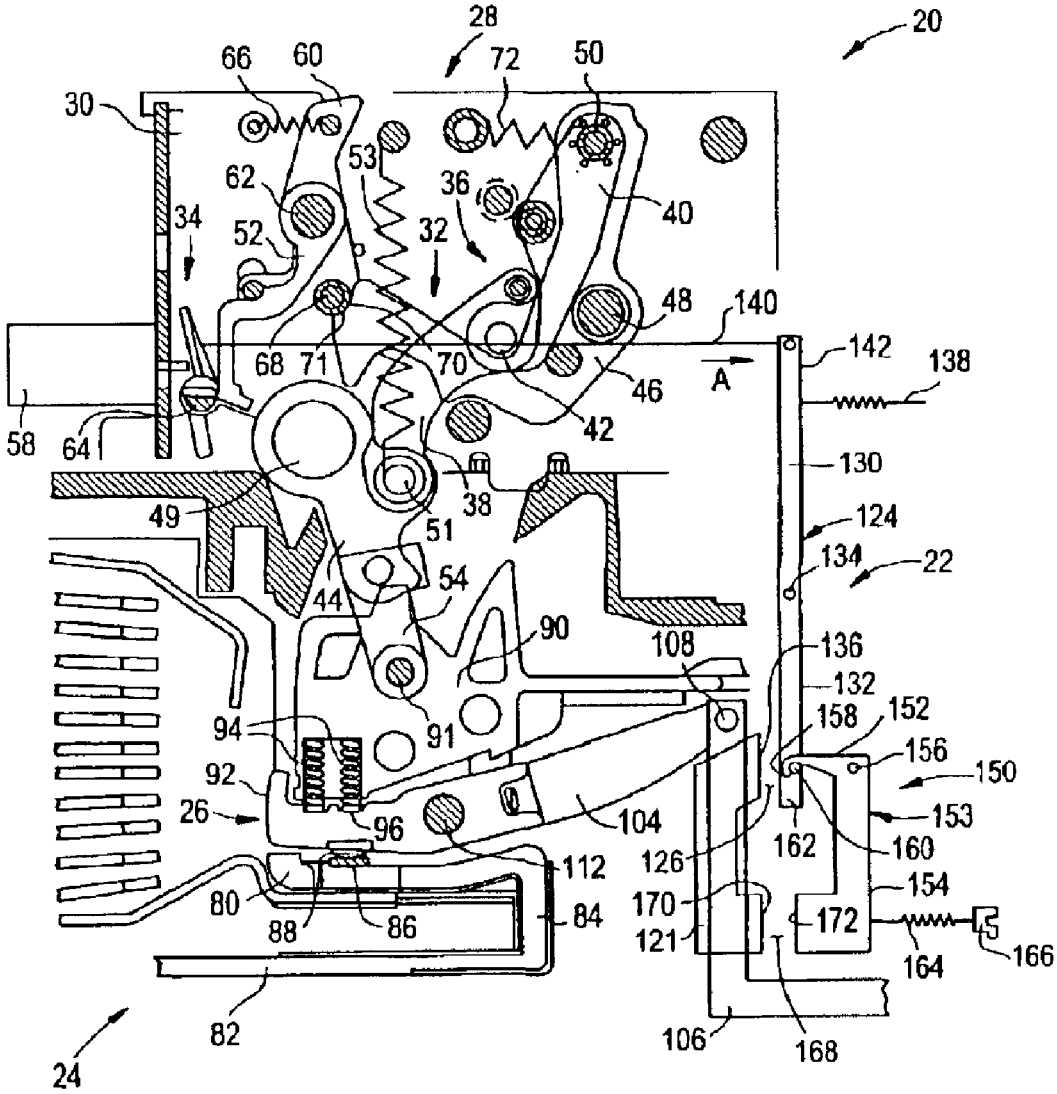
FIG. 3 is a schematic view of a third alternative embodiment of a pole of a circuit breaker comprising an auxiliary magnetic trip mechanism.
Figure 4:
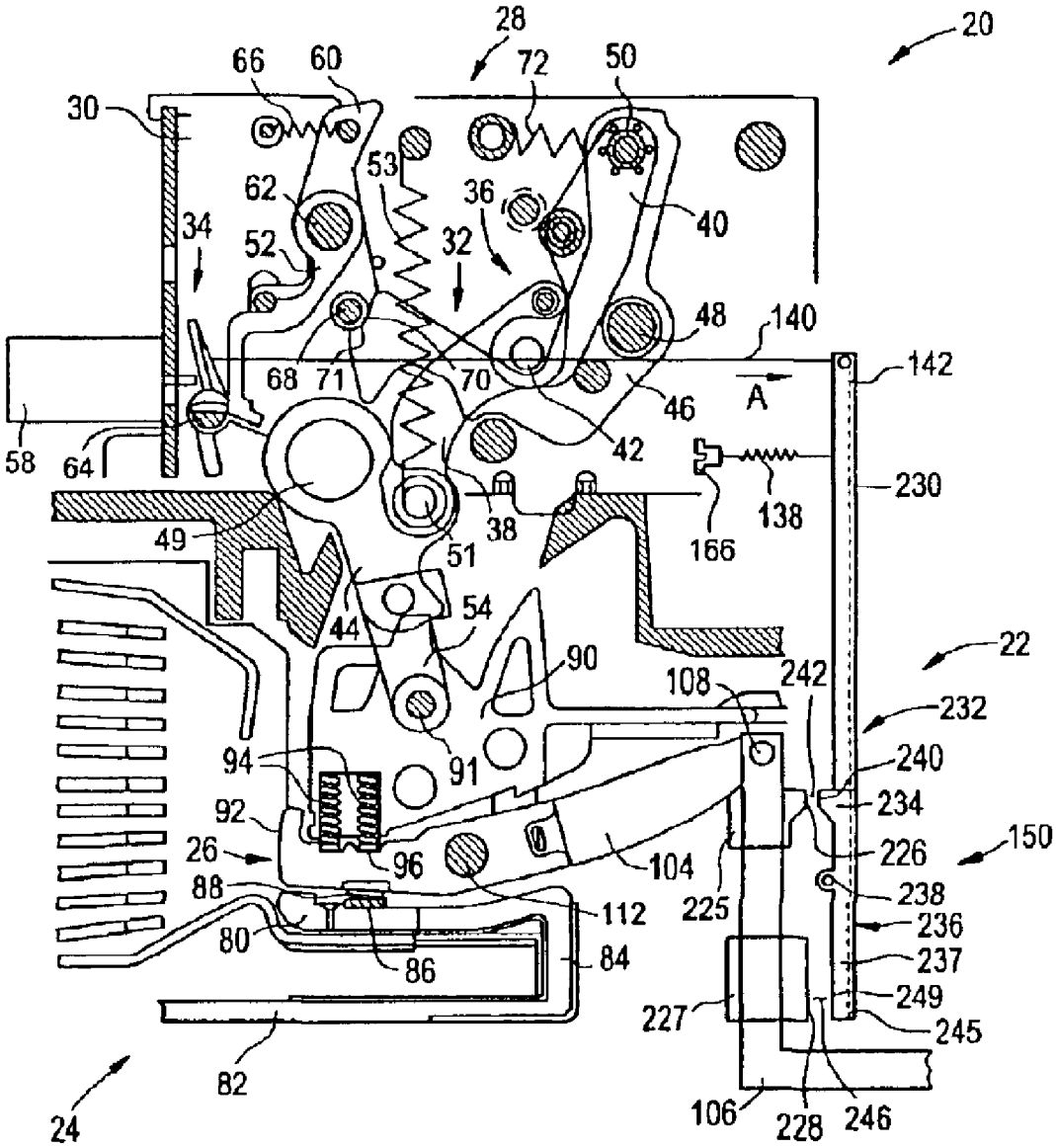
FIG. 4 is a schematic view of a fourth alternative embodiment of a pole of a circuit breaker comprising an auxiliary magnetic trip mechanism.

Referring to FIG. 1, in the first embodiment, there is first u-shaped collar 120 with pole face 136, and second u-shaped collar 122 with pole face 170. Referring to FIG. 2, in the second embodiment, there is u-shaped collar 224 with first pole face 226 and second pole face 228. Referring to FIG. 3, the first embodiment could also perform with a one u-shaped collar 121 with pole face 136 and pole face 170. Referring to FIG. 4, the second embodiment could perform with a first u-shaped collar 225 with first pole face 226 and a second u-shaped collar 227 with second pole face 228.

Figure 5:
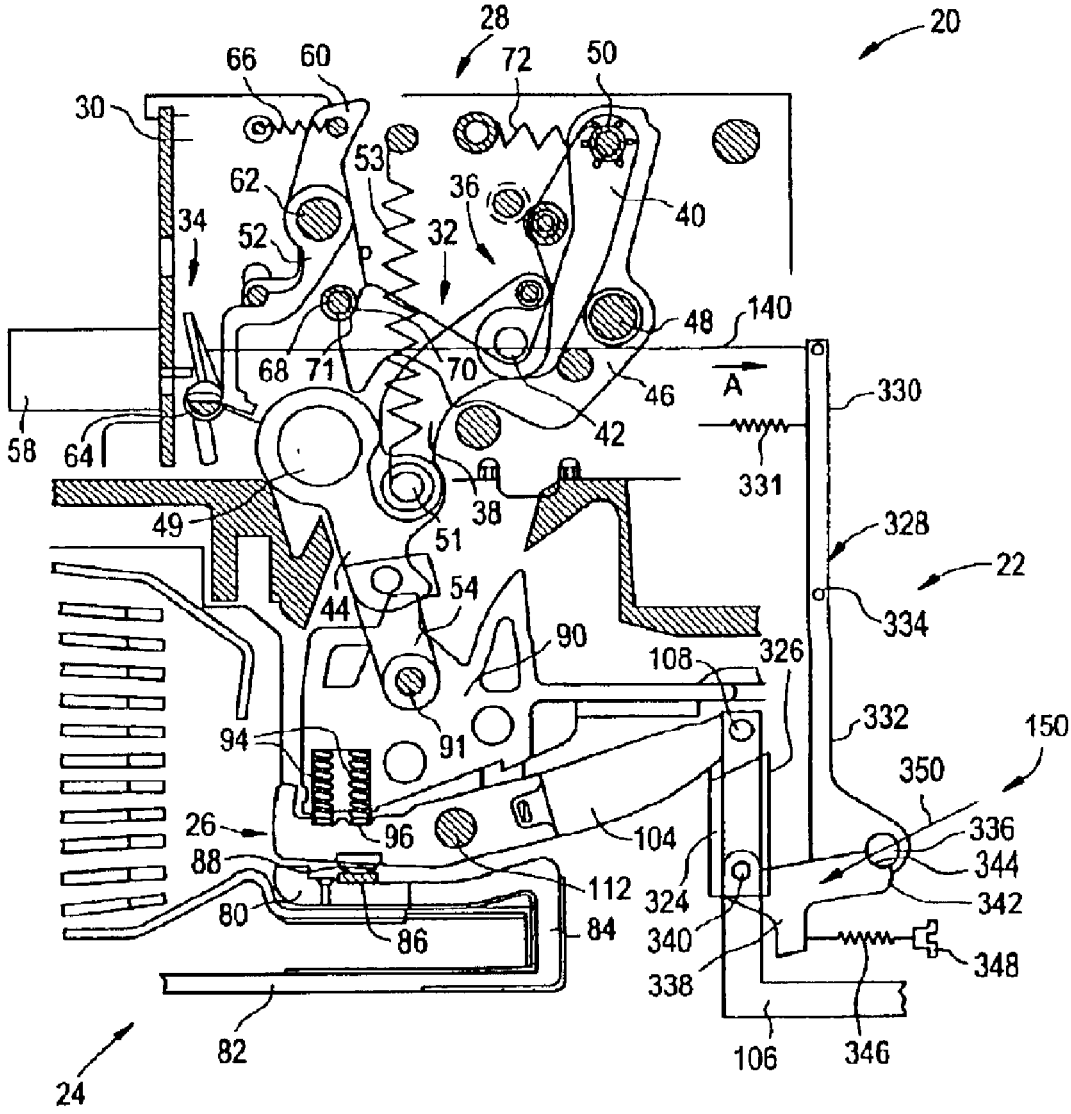
FIG. 5 is a schematic view of a fifth alternative embodiment of a pole of a circuit breaker comprising an auxiliary magnetic trip mechanism.

Referring to FIG. 5, a fifth alternative embodiment of auxiliary magnetic trip system 22 is illustrated. This embodiment utilizes the same operating mechanism 28, first contact structure 24, and second contact structure 26 as was described in the embodiment described in FIG. 1 (the first embodiment). Auxiliary magnetic trip system 22 is different from the first four embodiments as illustrated in FIGS. 1–4. As with the first through fourth embodiments, conductor 104 is pivotably connected to connection strap 106 by axis 108. However, in this embodiment auxiliary magnetic trip system 22 comprises a u-shaped collar 324 with just one pole face 326. As with the other embodiments, u-shaped collar 324 may be a yoke, a c-shaped collar, or the like.

Auxiliary magnetic trip system 22 includes a trip lever 328, which is located proximate to connection strap 106. Trip lever 328 comprises a first trip arm 330 coupled to a second trip arm 332 by an axis 334. First trip arm 330 is coupled with a spring 331, which is connected to frame 30. Second trip arm 332 is coupled with a pin 336.

Holdback system 150 in this embodiment includes an arm latch 338 that is pivotably connected with u-shaped collar 324 at axis 340; however, arm latch 338 could also be pivotably connected with frame 30. On the end of arm latch 338 is a latch end 342. Pin 336 pushes against latch end at a latch surface 344. Arm latch 338 is coupled to a spring 346, which is biased so that spring 346 prevents arm latch 338 from turning in a clockwise direction. A calibration screw 348 is coupled with spring 346 and is threadably engaged to bias arm latch 338 in a counter-clockwise direction. Calibration screw 348 provides that a predetermined amount of tension on spring 346 can be attained.

Auxiliary magnetic trip system 22 operates in the following manner. Current flows through first contact structure 24 to second contact structure 26 in the manner described in the first embodiment. Current flows through connection strap 106. As current flows through connection strap 106, a magnetic flux is induced in u-shaped collar 324, thereby creating a magnetic force between pole face 326 and second trip arm 332. The magnetic force at pole face 326 attempts to pull second trip arm 332 towards u-shaped collar 324. As the magnetic force increases, pin 336 is pushed against latch surface 344, which creates a force vector 350. Force vector 350 causes latch arm 338 to try and rotate clockwise around axis 340; however, spring 346 prevents latch arm 338 from rotating until force vector 350 overcomes the tension in spring 346. Arm latch 338 does not move until there is a predetermined amount of force created at pole face 326 and second trip arm 332. As the current increases and the magnetic force increases, pole face 326 has a magnetic force that attracts second trip arm 332, which causes pin 336 to push against latch surface 344.

When pin 336 pushes against latch surface 344 to the degree where there is impending motion of arm latch 338, the current has reached the withstand level. As the current increases higher and the magnetic force increases, the magnetic force between pole face 326 and second trip arm 332 also increases. At a predetermined magnetic force, arm latch 338 rotates and trip lever 328 is free to rotate in a clockwise direction, which causes linkage connection 140 to pull trip latch 64. When trip latch 64 rotates, it releases operating mechanism 28 and causes operating mechanism 28 to trip. Operating mechanism trips in the same manner as described in the first embodiment. When operating mechanism trips, second contact structure 26 moves away from first contact structure 24 so that line contact 86 and load contact 88 are no longer touching. When line contact 86 and load contact 88 separate, the circuit breaker is "tripped" and current can no longer flow through the circuit breaker.

Figure 6:
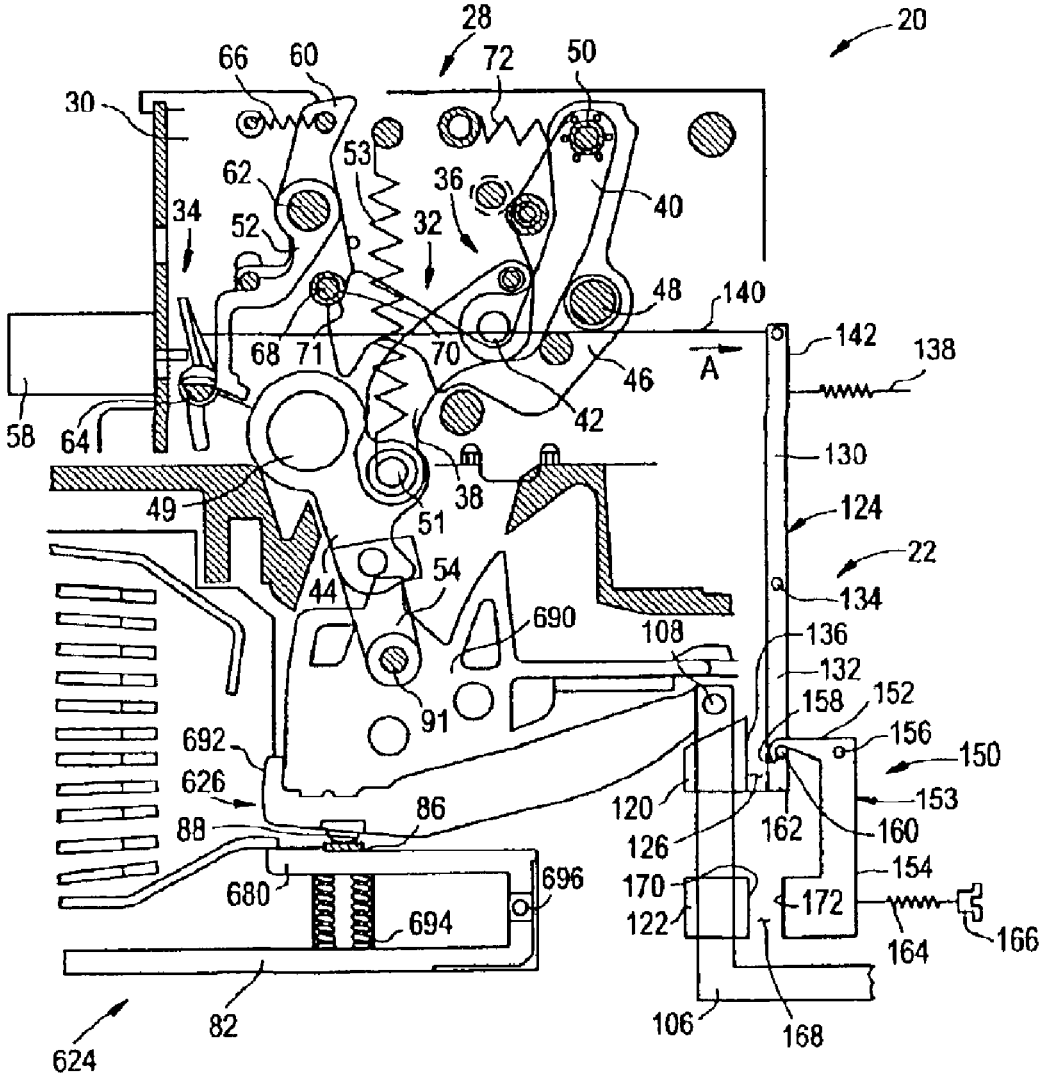
FIG. 6 is a schematic view of a sixth alternative embodiment of a pole of a circuit breaker comprising an auxiliary magnetic trip mechanism.

Referring to FIG. 6, auxiliary magnetic trip system 22 is shown with an alternative contact structure. In FIG. 6, the contact structure includes a first contact structure 624 and a second contact structure 626 wherein contact pressure springs act on first contact structure 624.

Second contact structure 626 includes an insulating carrier 690 coupled to a movable contact arm 692. Load contact 88 is coupled to movable contact arm 692. Carrier 690 is coupled to connecting rod 54 by pin 91. Movable contact arm 692 is pivotably connected to connection strap 106 by axis 108. Carrier 690 is also pivotally connected to connection strap 106 by axis 108.

Second contact structure 626 contacts first contact structure 624 at load contact 88. First contact structure 624 includes line contact 86 coupled to a contact arm 680. Contact arm 680 is coupled to contact strap 82 by an axis 696. Contact pressure springs 694 are arranged between contact arm 680 and contact strap 82. Contact pressure springs 694 allow contact arm 680 to move when second contact structure contacts first contact structure 624.

Circuit breaker 20 operates in the loaded position as shown and in the following manner. The current flows into contact strap 82 and flows through axis 696 to contact arm 680. Current crosses from line contact 86 to load contact 88 to movable contact arm 692. Current then flows through axis 108 to connection strap 106.

When movable contact arm 692 closes to the loaded position, contact arm 680 moves towards contact strap 82 by pivoting on axis 696 and compressing contact pressure springs 694. As with the first embodiment, there is a reverse loop created from the current flowing from right to left in contact arm 680 and current flowing from left to right in movable contact arm 692. The reverse loop causes an opposing force between movable contact arm 692 and contact arm 680. However, line contact 86 and load contact 88 stay in the closed position because operating mechanism 28 holds movable contact arm 692 so that movable contact arm 692 does not pivot open. As with the first embodiment, the initial rush of current is called the withstand rating of the circuit breaker because first contact structure 624 and second contact structure 626 stay in the closed position and are withstanding the flow of current. Auxiliary magnetic trip system 22 operates and trips in the same manner as described in the first embodiment.

Figure 7:
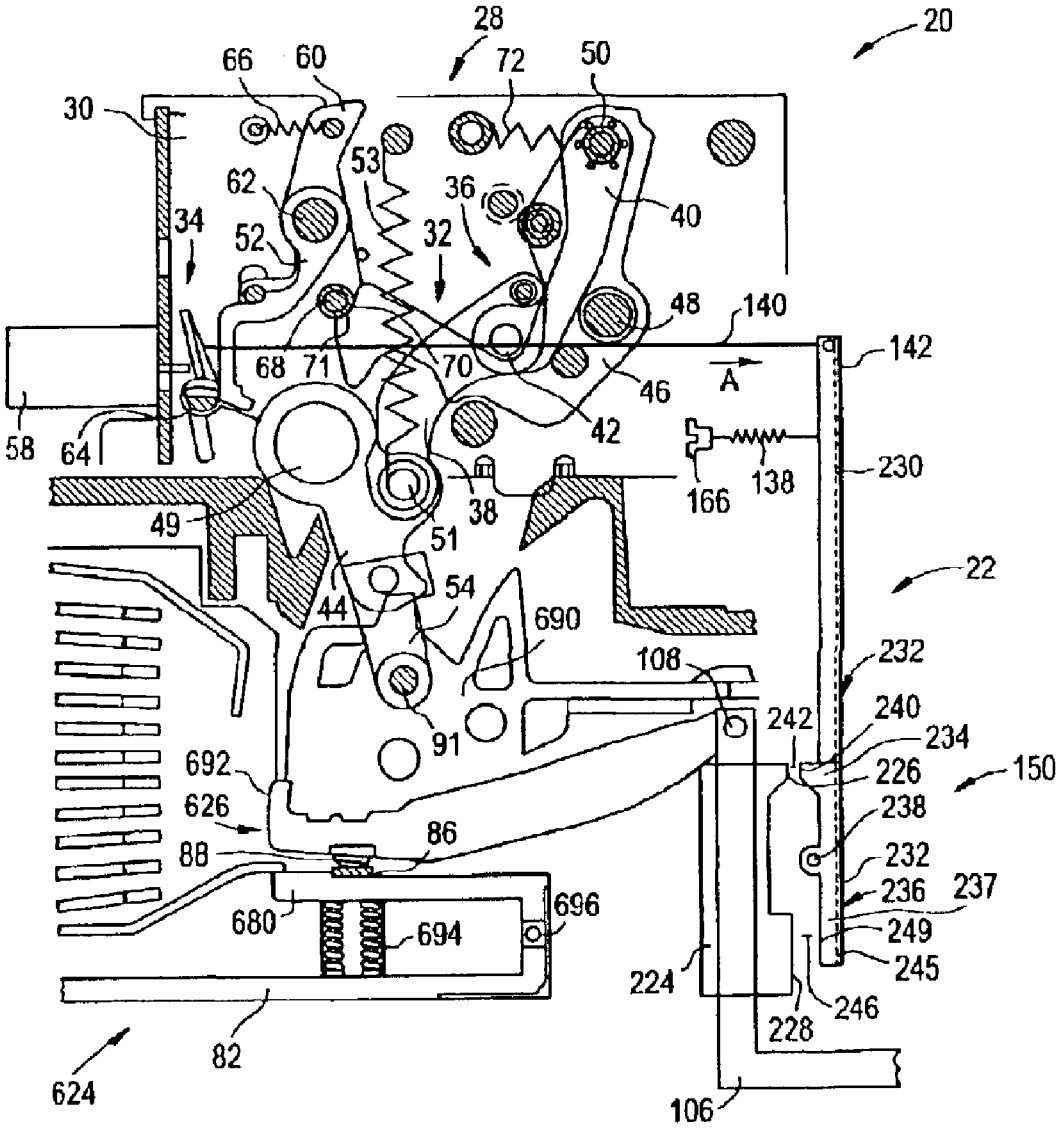
FIG. 7 is a schematic view of a seventh alternative embodiment of a pole of a circuit breaker comprising an auxiliary magnetic trip mechanism.

Referring to FIG. 7, first contact structure 624 and second contact structure 626 are combined with the second embodiment of auxiliary magnetic trip system 22 previously described with reference to FIG. 2. First contact structure 624 and second contact structure 626 operate in the manner described with reference to FIG. 6. Auxiliary magnetic trip system 22 operates in the same manner as described with reference to FIG. 2.

Figure 8:
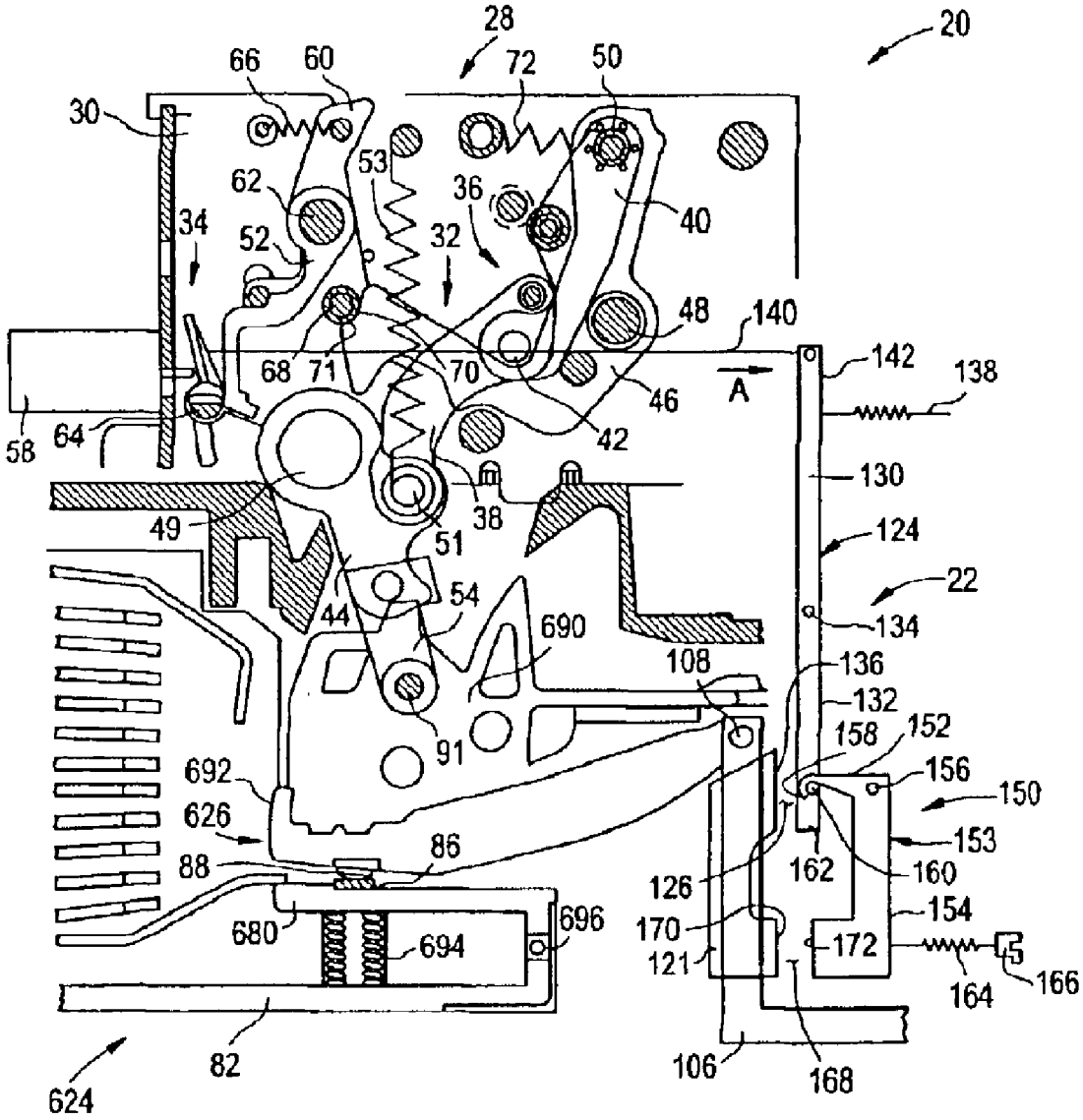
FIG. 8 is a schematic view of an eighth alternative embodiment of a pole of a circuit breaker comprising an auxiliary magnetic trip mechanism.

Referring to FIG. 8, first contact structure 624 and second contact structure 626 are combined with the third embodiment of auxiliary magnetic trip system 22 previously described with reference to FIG. 3. First contact structure 624 and second contact structure 626 operate in the manner described with reference to FIG. 6. Auxiliary magnetic trip system 22 operates in the same manner as described with reference to FIG. 3.

Figure 9:
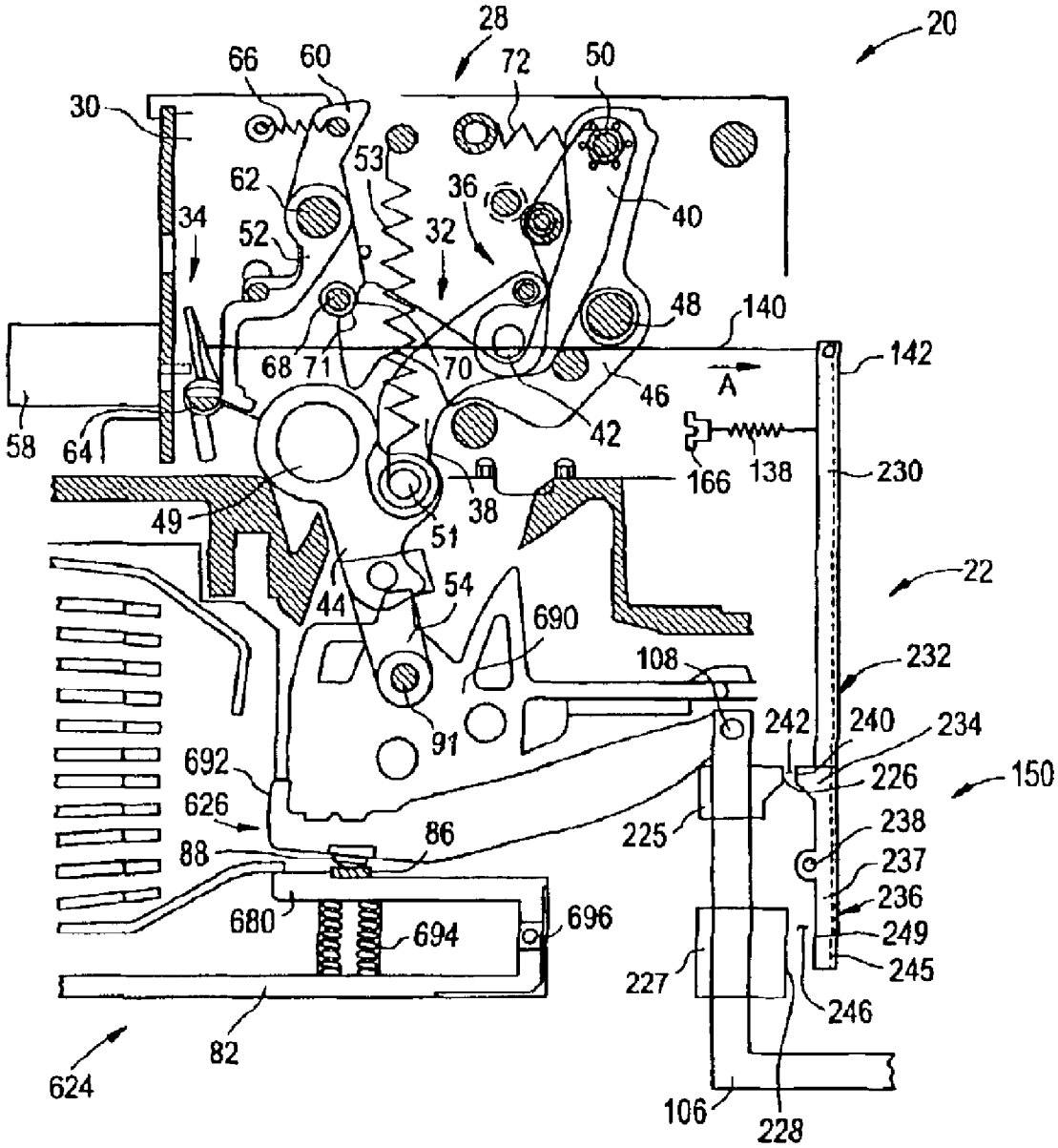
FIG. 9 is a schematic view of a ninth alternative embodiment of a pole of a circuit breaker comprising an auxiliary magnetic trip mechanism.

Referring to FIG. 9, first contact structure 624 and second contact structure 626 are combined with the fourth embodiment of auxiliary magnetic trip system 22 previously described with reference to FIG. 4. First contact structure 624 and second contact structure 626 operate in the manner described with reference to FIG. 6. Auxiliary magnetic trip system 22 operates in the same manner as described with reference to FIG. 4.

Figure 10:
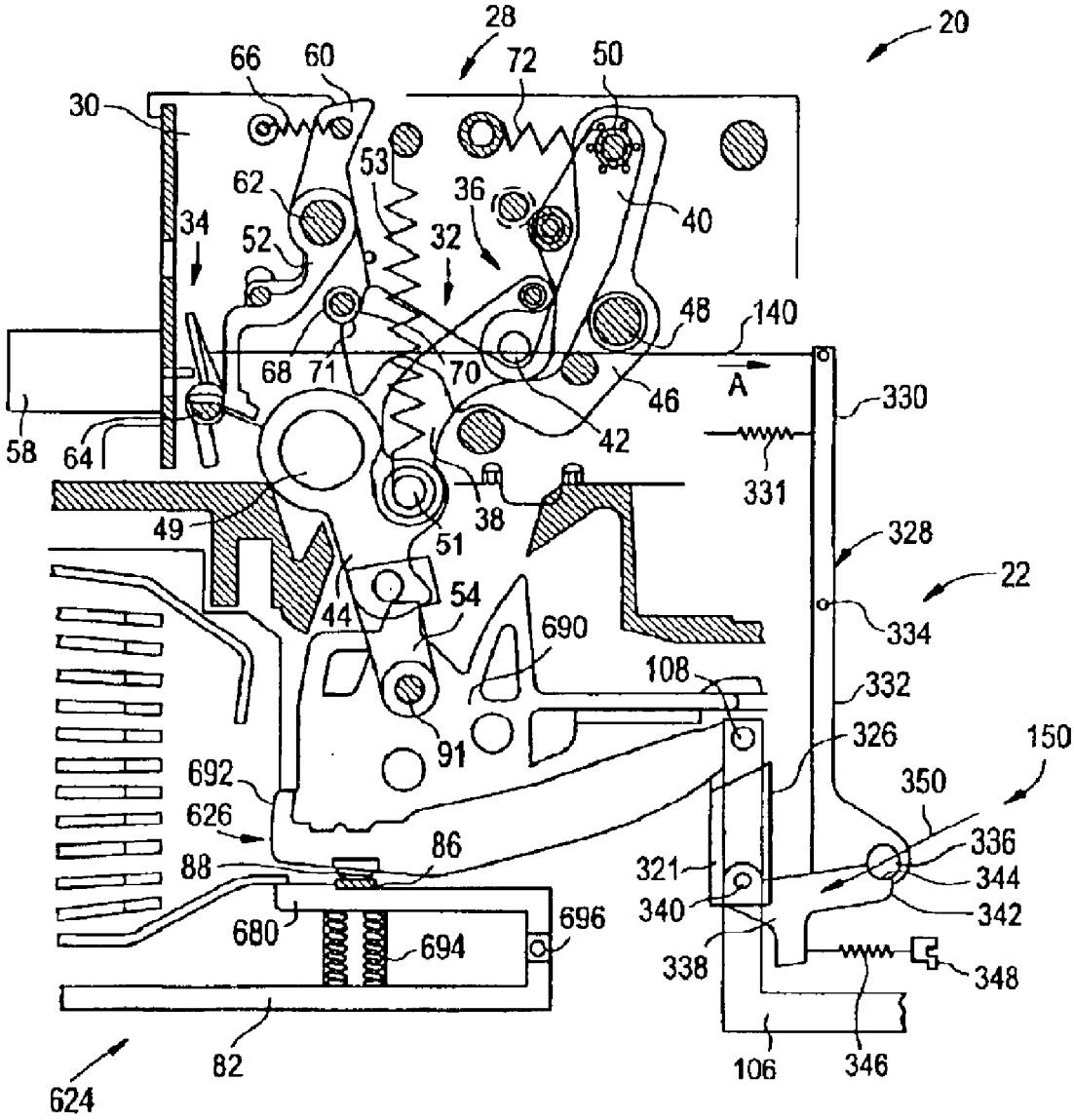
FIG. 10 is a schematic view of a tenth alternative embodiment of a pole of a circuit breaker comprising an auxiliary magnetic trip mechanism.

Referring to FIG. 10, first contact structure 624 and second contact structure 626 are combined with the fifth embodiment of auxiliary magnetic trip system 22 previously described with reference to FIG. 5. First contact structure 624 and second contact structure 626 operate in the manner described with reference to FIG. 6. Auxiliary magnetic trip system 22 operates in the same manner as described with reference to FIG. 5.

Auxiliary magnetic trip system 22 as described herein may be used to interrupt current in any type of system. Most notably, auxiliary magnetic trips system 22 may be employed in any residential, commercial, or industrial circuit breakers, including an air circuit breaker, a molded case circuit breaker, a multi-pole circuit breaker, and a rotary circuit breaker. In addition, while an embodiment for operating mechanism 28 has been described hereinabove, any operating mechanism for a circuit breaker may be utilized with the auxiliary magnetic trip system.

One of the advantages of the disclosure is that the tripping action of auxiliary magnetic trip system 22 can occur very quickly. In each of the embodiments described, the trip lever is preloaded during the withstand current level. Thus, when the short circuit current level has been reached and the auxiliary magnetic trip system trips the circuit breaker, the trip lever moves in a quick snapping action. A second advantage of the disclosure is that the reverse loop between the first contact structure and the second contact structure also creates an opposing force between the first contact structure and the second contact structure so that the second contact structure tends to be electromagnetically driven away from the first contact structure.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A circuit breaker comprising:

a first contact structure in contact with a second contact structure;

an operating mechanism arranged to separate said first contact structure and said second contact structure; and an auxiliary magnetic trip system comprising:

a strap configured to conduct a first level of electrical current and a second level of electrical current, said first level of electrical current is a withstand level;

a first u-shaped collar with a first pole face, said first u-shaped collar disposed around said strap;

a trip lever in operable communication with said operating mechanism, said trip lever disposed proximate said first pole face, said trip lever rotatably mounted on an axis; and a holdback system releasably coupled to said trip lever, wherein said holdback system prevents movement of said trip lever at said first level of electrical current and releases said trip lever at said second level of electrical current.

2. The circuit breaker of claim 1, wherein said holdback system includes:

a latch pin in operable communication with said trip lever;

an armature having a latching end, said latching end releasably engaged with said latch pin; and a second pole face disposed proximate to said armature.

3. The circuit breaker of claim 2, further comprising a second u-shape collar disposed around said strap, said second pole face is disposed at said second u-shape collar.

4. The circuit breaker of claim 2, wherein said second pole face is disposed at said first u-shape collar.

5. The circuit breaker of claim 2, further comprising a spring in operable communication with said armature.

6. The circuit breaker of claim 1, wherein said holdback system includes:

a pin in operable communication with said trip lever;

an armature having a latching end; and wherein said latching end is releasably engaged with said pin.

7. The circuit breaker of claim 6, wherein said armature is pivotably mounted to said strap.

8. The circuit breaker of claim 6, further comprising a spring in operable communication with said armature.

9. The circuit breaker of claim 1, wherein said holdback system includes:

a second pole face;

wherein said trip lever disposed proximate to said second pole face; and wherein said axis disposed between said first pole face and said second pole face.

10. The circuit breaker of claim 9, wherein said second pole face is smaller than said first pole face.

11. The circuit breaker of claim 9, further comprising a second u-shape collar disposed around said strap, said second pole face is disposed at said second u-shape collar.

12. The circuit breaker of claim 9, wherein said second pole face is disposed at said first u-shape collar.

13. The circuit breaker of claim 9, further comprising a spring in operable communication with said trip lever.

14. The circuit breaker of claim 1, wherein said first level of electrical current is a withstand level.

15. The circuit breaker of claim 1, wherein said second level of electrical current is a short circuit level.

16. The circuit breaker of claim 1, wherein said first contact structure includes:

a stationary contact arm; and a contact strap in operable communication with said stationary contact arm.

17. The circuit breaker of claim 1, wherein said second contact structure includes:

an insulating carrier;

a movable contact arm in operable communication with said insulating carrier; and a spring arranged between said insulating carrier and an upper face of said movable contact arm.

18. The circuit breaker of claim 1, wherein said first contact structure includes:

a contact arm;

a contact strap pivotably coupled to said contact arm; and a spring arranged between said contact arm and said contact strap.

19. The circuit breaker of claim 1, wherein said second contact structure includes:

an insulating carrier; and a movable contact arm in operable communication with said insulating carrier.

20. A method of tripping a circuit breaker comprising:

flowing a first level of electrical current through a strap;

inducing a magnetic force proportional to said first level of electrical current between a first pole face and a trip lever;

preventing movement of said trip lever at said first level of electrical current; and releasing said trip lever at a second level of electrical current;

The method, wherein said preventing includes latching a pin latch surface disposed at said trip lever with an armature.

21. The method of claim 20, wherein said releasing includes inducing a magnetic force between a second pole face and said trip lever.

* * * * *

UNITED STATES PATENT AND TRADEMARK OFFICE

CERTIFICATE OF CORRECTION

PATENT NO. : 6,853,277 B2
APPLICATION NO. : 10/064678
DATED : February 8, 2005
INVENTOR(S) : Roger N. Castonguay et al.

It is certified that error appears in the above-identified patent and that said Letters Patent is hereby corrected as shown below:

Column 5,
Line 14, after "and", delete ",".

Column 12,
Line 13, before "wherein", delete "The method,".
Line 14, before "latch", delete "pin".

Signed and Sealed this

Twenty-eighth Day of November, 2006

JON W. DUDAS
*Director of the United States Patent and Trademark Office*